United States Patent [19]

Cottrell et al.

[11] 4,363,959

[45] Dec. 14, 1982

[54] STAND-OFF FOR RESISTANCE WIRES

[75] Inventors: Merlyn F. Cottrell; Harold Tegelman, Jr.; Ronald E. Holmes, all of Winneconne; John R. Hofferber, Weyauwega, all of Wis.

[73] Assignee: E. R. Wagner Manufacturing Company, Milwaukee, Wis.

[21] Appl. No.: 297,726

[22] Filed: Aug. 31, 1981

[51] Int. Cl.[3] ..... H05B 3/06

[52] U.S. Cl. ..... 219/532; D13/18; 174/175; 219/536; 219/542

[58] Field of Search ..... 219/374, 375, 532, 536, 219/537, 542, 546; 174/138 J, 175, 212; 338/304, 320, 299; D13/17, 18

[56] References Cited

U.S. PATENT DOCUMENTS

| | | | |
|---|---|---|---|
| D. 207,057 | 2/1967 | Palmer | D13/18 X |
| D. 248,943 | 8/1978 | King | D13/18 |
| D. 261,260 | 10/1981 | Seeley | D13/18 |
| D. 262,285 | 12/1981 | Janning | D13/18 |
| 2,856,500 | 10/1958 | Hartman | 219/536 |
| 4,250,399 | 2/1981 | King | 219/532 |
| 4,268,742 | 5/1981 | Cottroll et al. | 219/532 |

*Primary Examiner*—Volodymyr Y. Mayewsky
*Attorney, Agent, or Firm*—Bayard H. Michael

[57] ABSTRACT

The insulative stand-off is mounted on a frame and supports a heating coil. In the preferred embodiment the coil loops engage retention surfaces inside the inverted T-shaped opening in the end of the stand-off. The sides of the stand-off forming the opening have cam surfaces which squeeze adjacent central loops together during mounting while the loops adjacent the central loops are deflected to the outside of the stand-off. When the central loops reach the crossbar of the T they spring apart to fix the coil. Other embodiments are shown—all have retention surfaces generally parallel to the coil loops and transverse the coil axis. Cam surfaces control access to the retention surfaces to deflect the loops as they are moved to the retention surfaces and the coil resiliency biases the loops into engagement with the retention surfaces when mounting is completed.

4 Claims, 12 Drawing Figures

STAND-OFF FOR RESISTANCE WIRES

BACKGROUND OF THE INVENTION

Coiled electric heating coils are usually supported on electrically insulating supports (called "insulators" or "stand-offs" in the art) carried by a frame. The design of the support has been the subject of much attention. The supports are usually of ceramic material and must be able to withstand handling during production and assembly. The support should be easily mounted on the frame and should permit simple connection of the coil to the support. And, of course, the support should securely fix the coil to the frame while allowing for dimensional changes of the coil as it is heated.

U.S. Pat. No. 4,268,742 shows a heater assembly utilizing a stand-off (which was the subject matter of a separate application Ser. No. 85,757 abandoned in view of U.S. Pat. No. 2,856,500) which was a significant simplification over the stand-offs in use. The retention features were good but mounting the coil on the insulator required the coil to be turned 90° from its mounted position in order to pass over the end of the stand-off. Then the coil was turned back 90° to secure the coil. This consumed too much time and ran the risk of damage to the coil as well as the risk of not having the coil figuration as designed due to difficulty in determining which coil loops to secure to the insulator.

SUMMARY OF THE INVENTION

The principal object of this invention is to provide an insulator which retains a coil securely and permits easy mounting of the coil. Another object is to provide an insulator which permits a coil to be mounted in the same relationship during mounting as it has when mounted. Thus, there is no twisting of the coil relative to the insulator during mounting. The support is a relatively thin ceramic member mounted in the frame and having an end configuration designed to facilitate mounting the coil and retention of the coil. The cross sectional shape of the end of the insulator is rectangular with long and short axes. The coil axis is parallel to the long axis of the support during and after mounting the coil. Various designs are shown. All designs provide camming surfaces which deflect the coil loops as the coil is moved to the mounted position. In the mounted position the coil loops contacting the support are deflected from their unstressed state and the loops are biased into the retaining surfaces.

BRIEF DESCRIPTION OF THE DRAWINGS

The various modifications are shown in order of preference.

DETAILED DESCRIPTION OF THE DRAWINGS

Figure 1:
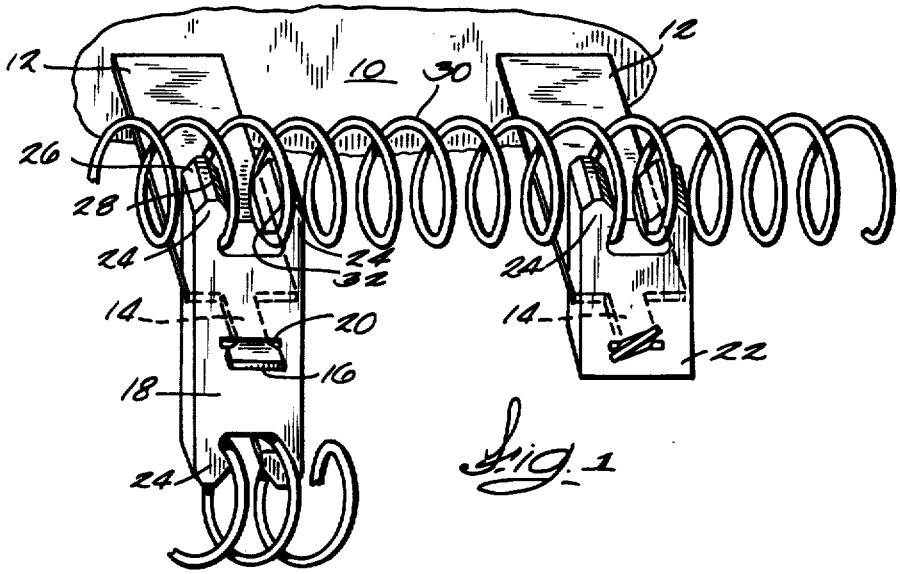
FIG. 1 shows the most preferred structure and the insulating supports shown accommodate a coil on both sides of the frame (left in FIG. 1) or only one side (right in FIG. 1).

FIG. 1 illustrates, somewhat schematically, a frame 10 having metal arms 12 projecting therefrom. The distal end of each arm 12 has a reduced projecting finger 14 having an enlarged head 16. The ceramic insulating support or stand-off 18 on the left of FIG. 1 has a central aperture 20 through which the enlarged head projects. The backside of the support 18 has a transverse slot the thickness of arm 12 to receive the end of the arm and prevent twisting the support 18 relative to arm 12. The enlarged head 16 is then twisted as illustrated on the right of FIG. 1 to retain the ceramic support in position on the arm. The length of the finger 14 is equal to the thickness of the support 18 less the depth of the slot. This comprises a very simple, rapid and secure method of fixing the support 18 on the arm 12. As may be seen in FIG. 1, the ceramic support 18 on the left in FIG. 1 is provided with two similar ends for supporting coils on each side of the frame. The right side of FIG. 1 illustrates a support 22 having only one end for supporting a coil. All of the various supports described herein can be single or double ended.

In the preferred embodiment, illustrated in FIG. 1, each side of the coil supporting end of the stand-off 18 or 22 is provided with a projection 24 which hooks inwardly to form a generally T-shaped opening between the projections 24 with the crossbar of the T towards the center of the stand-off. The outer end of each projection 24 has a surface 26 sloping towards the outside and a surface 28 sloping towards the opening between the two projections. These surfaces 26, 28 serve as camming surfaces. When the coil 30 is pressed down on the end of the stand-off, the surfaces 28, 28 will press the two inner coil loops (generally in alignment with the T-shaped opening) towards each other until they pass underneath the hooked portions 32, 32 and can snap back to substantially towards their relaxed or unstressed state. Thus, when the loops have been pressed down to the bottom of the T-shaped opening, they move apart to engage the retaining surfaces on the inside of the projections 24, 24. If the loops of the coil are close together, the surfaces 26, 26 will spread apart the loops adjacent those to be retained in the T-shaped opening. The coil is retained axially and is also retained against movement away from the stand-off 18. The only way the coil can be released is to squeeze the retained coil loops towards each other to free them from the retaining surfaces on the insides of the T-shaped opening. Mounting the coil is very rapid. The coil is simply placed in alignment with the long axis of the stand-off and pressed downwardly, thus squeezing the coil loops together until they snap into position.

Figure 2:
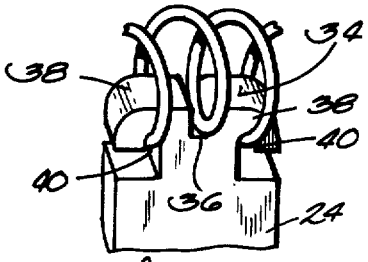
FIG. 2 shows the next preferred embodiment.
Figure 6:
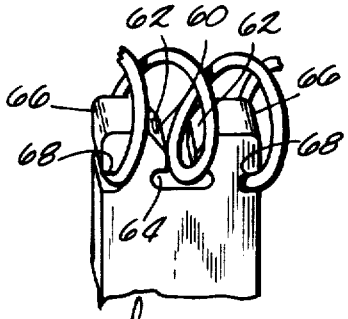
FIGS. 6, 7, 8, and 9 show still another support which can support a medium coil (FIG. 6), a small coil (FIG. 7), a large coil (FIG. 8), or three coils (FIG. 9) (or two coils, not shown).
Figure 7:
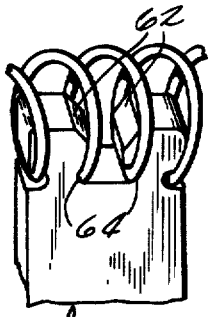

The embodiment shown in FIG. 2 has a different support structure on the end of the stand-off 24. Thus, the projection 34 is generally T-shaped and has a central slot 36. The outer ends of the crossbar of the T are rounded at 38, 38 to form camming surfaces which will spread coil loops apart. The undersides of the T-shaped projection 34 have transverse undercuts 40, 40 designed to receive coil loops. It will be noted here that adjacent coil loops do not engage the underside but there is one loop between the loops engaged in the undercuts and that is the one engaging the transverse slot 36. Thus when the coil is pressed down, the surfaces 38, 38 will spread apart the outer of the three loops shown while the center loop shown will engage the slot 36. When the two outer loops have been cammed apart by surfaces 38, 38 they will reach the opening underneath the crossbar of the T-34 and spring back in and up. The bottom of the transverse central cut 36 is approximately in the same plane as the bottom of the undercuts 40, 40 so the loops are stressed transversely relative to one another and are stressed to hold the center loop to the bottom of cut 36 and hold the outer loops up into the undercuts 40, 40.

Figure 4:
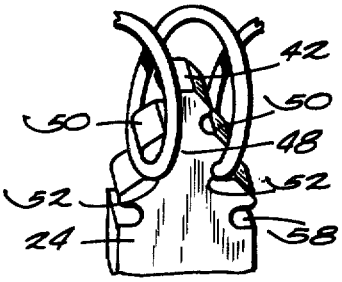
FIGS. 3, 4 and 5 show another embodiment where the same support can accommodate large, medium and small coils, respectively.
Figure 3:
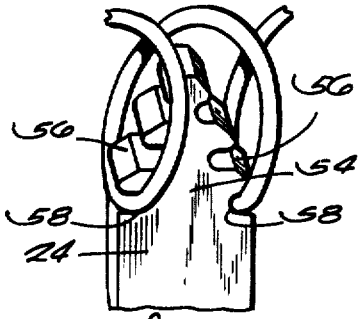
Figure 5:
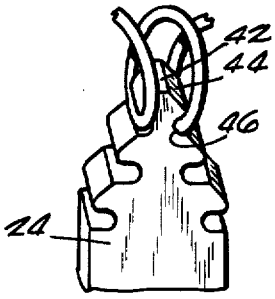

FIGS. 3, 4 and 5 show still another formation of the supporting end of a stand-off 24. This design is somewhat like a Christmas tree in plan view. It is characterized by an outer tip portion 42 generally in the shape of a T having camming surfaces 44 leading to an undercut 46. As may be seen in FIG. 5, a small coil with closely spaced loops can be mounted on this outer T-section by pressing the coil down on the stand-off to spread the coil loops until they spring back towards each other and engage the underside of the tip 42, that is, they engage the undercuts 46. The stand-off of this embodiment is also provided with a medial T-section 48 which also has camming surfaces 50, 50 which terminate in the undercut 52, 52 and these will be engaged by a medium-sized coil as it is pressed onto the stand-off. Thus medium-sized loops will pass over the tip 42 to engage the camming surfaces 50, 50 which spread the coil loops until they snap back and engage the undercut 52, 52. Finally, this embodiment has a proximal T-section 54 which also has camming surfaces 56, 56 to spread the loops of a large coil until those loops can spring back towards each other and engage the undercuts 58, 58. Thus the one stand-off can mount small, medium or large coils. This has advantage in reducing the number of stand-offs necessary to be carried in inventory.

Figure 8:
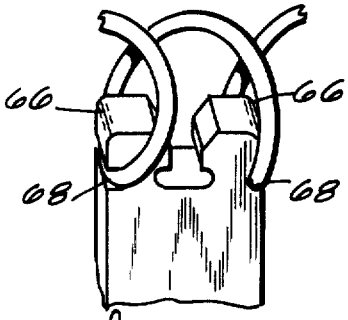
Figure 9:
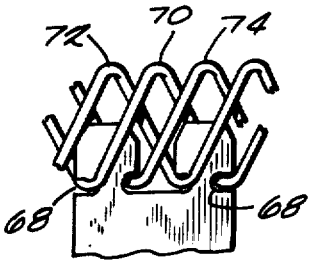

Another multi-purpose design is shown in FIGS. 6, 7, 8, and 9 in which the outer end of the stand-off is provided with a central inverted T-shaped opening 60 having camming surfaces 62 leading to the crossbar 64 of the opening. The outside edges of this stand-off are also provided with slight camming surfaces 66, 66 to spread coil loops engaging those surfaces to permit those loops to pass down to the sidecuts 68, 68. Thus, as may be seen in FIG. 6, a medium-sized coil can be mounted so that the outside loops of the three shown would be spread by surfaces 66, 66 to engage the sidecuts 68, 68 while the center loop passes through the central inverted T-opening. If a small coil is to be mounted on this stand-off, the outside loops of the four shown in FIG. 7 will be spread while the two loops between the outside loops will get squeezed together by surfaces 62, 62 until they reach the bottom of the inverted T-shaped opening and spring apart to engage the undercuts 64, 64. Thus this one embodiment now can mount a middle-size or a small-size coil. In FIG. 8 it will be apparent that this same stand-off can be used to mount a large coil. In this instance, two adjacent loops will be spread by the surfaces 66, 66 until the coil has been pressed far enough down so the loops can snap into the sidecuts 68, 68 and be retained in that manner. This design can also mount three independent coils as shown in FIG. 9. Thus in FIG. 9 the coil 70 engages the lefthand and righthand sidecuts 68. The coil 72 engages the righthand undercut of the T-shaped opening while the coil 74 engages the lefthand undercut of the T-shaped opening. It will be obvious that the coil 70 is the most securely retained on this stand-off but by mounting additional stand-offs nearby on each side of the illustrated stand-off the coils 72 and 74 can be retained at two points of engagement on an adjacent stand-off.

Figure 10:
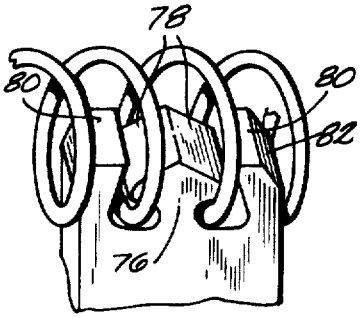
FIG. 10 shows another support.

In FIG. 10 the central projection 76 has camming surfaces 78, 78 serving to spread the middle two coil loops and feed them into the openings between the T-shaped central projection and the projecting sides 80, 80. The corners 82 of each of the projecting sides serve as camming surfaces spreading the outer of the four coil loops. Therefore, as the coil is pressed down, the inner two coil loops are spread until they can pass under the T-shaped head to engage the retaining surfaces on the underside of the T-shaped head. At the same time the outer loops held on the outside of the stand-off and the coil is securely mounted.

Figure 11:
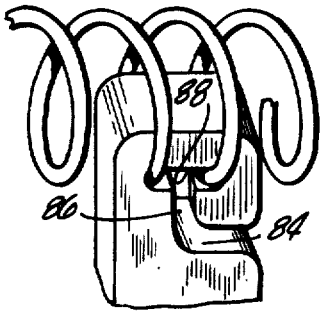
FIG. 11 shows a further support in which the coil loops enter the retention area from below.

In FIG. 11 the distal end of the stand-off is provided with a sidecut 84 leading to an outwardly extending slot 86 terminating in a transverse opening 88. In order to mount the coil in this arrangement the two coil loops are fed into the opening 84 laterally and then turned slightly upwardly until they reach the transverse opening 88 and can spring apart to the position shown. The resiliency of the coil loops will hold the loops in the transverse opening. In this design the camming of the loops during mounting is accomplished by the passageway formed by the openings 84, 86.

Figure 12:
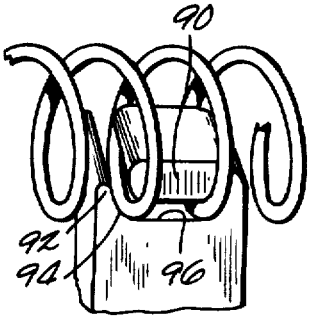
FIG. 12 shows a design in which the loops to be retained slide into the tip of the support.

FIG. 12 illustrates still another variation. Here the distal end of the stand-off is provided with a hook portion 90 terminating a short distance away from the keeper portion 92 so there is an inwardly inclined opening 94 between the end of the hook 90 and the keeper leading to the transverse passage 96. In this design the two retained loops are fed into the passageway between the end of the hook and the keeper until they reach the transverse passage 96 at which time they are allowed to spring apart to engage the ends of the transverse passage 96 to securely mount the coil on the stand-off.

All of these designs are characterized by having retention surfaces generally parallel to the coil loops and transverse the coil axis. The retention surfaces are spaced apart so as to require deflection of the loops to disengage them from the retention-engaged surfaces. The loops are self-biased into engagement with the surfaces. In all designs during mounting the coil loops engage cam surface means leading to the retention surfaces so the loops are deflected as they are mounted.

I claim:

1. A heater assembly comprising, a frame, an electrically insulating support mounted on the frame with an end spaced from the frame, an electric resistance heating coil mounted on the end of the support, the loops of the coil being axially spaced by a predetermined distance when the coil is unstressed, said support end having a central inverted T-shaped opening forming retention surfaces located at the ends of the cross bar of the T, said support retention surfaces being engaged by loops of the coil and spaced so the coil loops must be deflected to be mounted on or disengaged from the retention surfaces, said retention surfaces being operative to restrain the coil against axial movement and movement away from the support, said support end including cam surface means leading into the T-shaped opening and operative as the coil is moved toward the retention surfaces to deflect the coil loops from their unstressed spacing, the axis of the coil being transverse the retention surfaces during and after mounting the coil on the support, the support end including a stop surface engaged by a coil loop during assembly to limit movement of the coil onto the support while positioning coil loops to engage the retention surfaces.

2. An assembly according to claim 1 in which the outer corners of the support are provided with cam surface means to spread coil loops engaging therewith during mounting of the coil.

3. An assembly according to claim 2 including side-cuts in the support end generally in the same plane as the crossbar of the T-shaped opening and engageable by coil loops spread by the cam surfaces on said outer corners.

4. A heater assembly comprising, a frame, an electrically insulating support mounted on the frame with an end spaced from the frame, an electric resistance heating coil mounted on the end of the support, the loops of the coil being axially spaced by a predetermined distance when the coil is unstressed, said support end having a central inverted T-shaped opening forming retention surfaces located at the ends of the crossbar of the T, said retention surfaces being engaged by loops of the coil and spaced so the coil loops must be deflected to be mounted on or disengaged from the retention surfaces, said retention surfaces being operative to restrain the coil against axial movement and movement away from the support, said support end including cam surface means leading into the T-shaped opening and operative as the coil is moved toward the retention surfaces to deflect the coil loops from their unstressed spacing, the axis of the coil being transverse the retention surfaces during and after mounting the coil on the support.

* * * * *